US005636710A

United States Patent [19]

Ables et al.

[11] Patent Number: 5,636,710

[45] Date of Patent: Jun. 10, 1997

[54] PNEUMATIC DELIVERY SYSTEM FOR RESTAURANT FOOD

[75] Inventors: Charles L. Ables, Rome; Peter E. Crull, Kennesaw; Donald E. Evans, Rome, all of Ga.

[73] Assignee: Ace Food Services, Inc., Rome, Ga.

[21] Appl. No.: 528,978

[22] Filed: Sep. 15, 1995

[51] Int. Cl.[6] ..... E04H 3/02; B65G 49/05; B65G 51/34

[52] U.S. Cl. ..... 186/41; 186/49; 406/13; 406/184

[58] Field of Search ..... 186/37, 38, 40, 186/41, 43, 49, 50, 51, 53, 55, 58; 406/1–9, 11, 13, 110–112, 147–150, 176–180, 184–190

[56] References Cited

U.S. PATENT DOCUMENTS

| | | | |
|---|---|---|---|
| 2,405,294 | 8/1946 | Delucchi . | |
| 2,827,130 | 3/1958 | Daifotes . | |
| 2,904,131 | 9/1959 | Bailey . | |
| 3,294,342 | 12/1966 | McClure et al. | 186/37 X |
| 3,599,898 | 8/1971 | Bontempelli | 186/37 X |
| 4,311,211 | 1/1982 | Benjamin et al. . | |
| 4,712,650 | 12/1987 | Campbell | 186/41 |
| 4,733,754 | 3/1988 | Acosta . | |
| 4,957,188 | 9/1990 | Bavis | 186/41 |
| 5,113,970 | 5/1992 | Bavis . | |
| 5,287,948 | 2/1994 | Casale et al. | 186/41 |

OTHER PUBLICATIONS

Exhibits marked 1–8 are photographs of Chick–Fil–A conveyor which existed at least as early as the filing date of the application.

Exhibits 9–12 are photographs of Captain D's Vittleveyor device and Vittleveyor which existed at least as early as the filing date of the application.

*Primary Examiner*—Karen B. Merritt
*Assistant Examiner*—Scott L. Lowe
*Attorney, Agent, or Firm*—James L. Ewing, IV; Kilpatrick & Cody

[57] ABSTRACT

Restaurants featuring improved efficiency through use of pneumatic systems for delivery of fast food products from a kitchen area to a food delivery area, such as in an out building, can revolutionize the fast food industry. A customer order entry station is located on a first side of the restaurant, and an order unit transmits order entry information to an indicator located adjacent to the kitchen area. A pneumatic dispatch station located adjacent to the kitchen area is connected via a second dispatch unit located in the food delivery area to a pneumatic tube. Upon the taking of a customer's order, the order entry information is acted upon by food service personnel who prepare food products such as sandwiches and load them into the kitchen area dispatch station for transport to the food delivery area. The food products reach the customer who has, by this time, navigated around the restaurant to the out building. Soft drink and french fry stations may be located in the out building, so that only sandwiches and other fast food products which can withstand substantial shock need be transported in the pneumatic food carrier.

20 Claims, 3 Drawing Sheets

PNEUMATIC DELIVERY SYSTEM FOR RESTAURANT FOOD

BACKGROUND OF THE INVENTION

This invention relates to apparatus and processes for increasing efficiency of restaurants using pneumatic food product transportation systems.

Fast food restaurants are a phenomenon of modern life for many reasons, all of which create incentives to dine out more often while spending less time in the process, but not with a sacrifice in the quality of the dining experience. Customers increasingly demand more convenience, speedy service, and high quality at a reasonable price, and success falls on those restaurants which accommodate these desires. Fast food restaurants accordingly endeavor to meet these challenges with innovative ideas.

One concept employed by several major contenders in the fast food industry is the use of two drive-thru windows. After the customer orders at a menu board, he or she pays at the first window where an employee takes payment, makes change, and enters order entry information. The customer proceeds to the second window where an employee delivers the requested food products. A variation on this theme adds a second order board, which is spaced at an interval that is intended to allow two cars simultaneously to order from the two separate boards. However, variations in vehicle length, unforeseen and complex purchase requirements, and different driver habits affect the effectiveness of this model.

Another approach incorporates conveyor apparatus for taking payment from the point of order and delivering the food products at the same point of order while the customer waits in the car. Such a system is disclosed in U.S. Pat. No. 4,311,211, for instance, which discloses a packaged food delivery system having multiple ingress and egress lanes with remote dispensing stations. Packaged food is transported from a central site to remote dispensing stations using an overhead electrically driven carrier for transporting a gimballed tray carrying money and food products. Variations on this structure include multiple drive-thru lanes with a variety of order points and delivery points. Such systems obviously present problems when subjected to the fast food business. First, the conveyor system is mechanically intricate, subject to the elements, and thus prone to mechanical failure. Food contents also tend to foul the mechanism; items such as soft drinks and french fries may spill between point of departure and delivery at the customer's vehicle. Such conveyor systems are also positioned overhead and are therefore less pleasing aesthetically while exposed to vandals and the elements. Errant drivers of large trucks, campers, vans and those who stray from the right of way also present obvious complications for such systems.

A recent trend is the double drive-thru fast food restaurant concept, in which a small limited menu restaurant is situated on a site which allows for two drive-thru lanes, one on each side of the building. The restaurant features two order boards, one for each lane, and which correspond to two drive-thru windows at which the payment is taken, change given, and the food products delivered. These double drive-thru restaurants generally do not offer inside seating, but they do offer walk-up ordering from the front of the building and outside seating on picnic-type tables in a landscaped area of the site. One disadvantage arising from this concept is that the drive-thru window on the secondary side requires that the customer pay, take change and receive food from the passenger side of the vehicle. Customers often find leaning across the passenger seat to receive the food items unappealing.

Serving multiple drive-thru customers quickly and efficiently has long been a goal of the fast food industry and unusual concepts continue to be offered to meet that goal. U.S. Pat. No. 4,733,754 addresses that issue by providing a building layout that offers three drive-thru windows access through a single ingress lane with two order boards and three egress lanes to facilitate traffic flow. At first glance, this concept seems to accomplish several facets of the challenges that the multiple drive-thru scheme seeks to address. However, experience and careful review show that this approach presents a potential for vehicle accidents created as customers who have placed their orders at one of the two order boards attempt to overtake other vehicles already at one of the delivery windows in order to reach their respective delivery window. Parking lot traffic seems to be chaotic in any event, which is only increased by the uncertainty and multiple stops and starts. Additionally, customers often feel intimidated with complicated lane changing and navigational challenges which are not immediately apparent when all they seek to do is to buy lunch. While all of these concepts are intriguing, the issue of accommodating faster and more efficient fast food delivery in a relatively simple manner has failed to be adequately addressed.

SUMMARY OF THE INVENTION

In the conventional layout of a fast food restaurant site, the restaurant building faces the street in a perpendicular fashion and customer vehicles enter the site on the right side of the building (looking from the street). If the customers plan to dine inside the building, then they choose a parking space from those that surround the building and access those spaces using the multiple lanes that surround the building. Those customers who desire to use a drive-thru window, however, use special designated lanes that lead them first to the order board (typically toward the back of the building) and then on around the building to the drive-thru window (if a one window configuration). The drive-thru window is typically located on the egress side of the restaurant, where customers pay, receive change, and receive ordered food. In a two window configuration, the customers pay at one window and receive food at a second window so that the traffic can continue to move.

The layout of the site for the present invention maintains the conventional configuration of the building perpendicular to the street with ingress on the right and egress on the left side of the building. Primary changes to the site plan include (1) a relocation of the order board to the ingress side of the main building, (2) addition of a satellite drive-thru or out building to support a second delivery window at the rear of the site, behind and to the side of the existing primary fast food building, (3) restriping of the drive-thru lanes directing traffic flow through the site; and (4) a pneumatic food product delivery system to deliver food products from the kitchen area of the main building to the out building for delivery to customers. The invention may thus be retrofitted into existing restaurant sites easily and inexpensively.

The usual location of the order board in a fast food restaurant offering drive-thru service is on the same side of the building as the drive-thru window is located. There is usually sufficient space between the order board and the drive-thru window for several cars to "stack" while waiting for orders to be filled and delivered. In most instances, the employees working the drive-thru window can see the order board from the window area and thus monitor how traffic is progressing. In a busy fast food location, however, it is not uncommon for cars to queue all the way around the building and in some instances into the street.

The present invention places the order board on the ingress side of the building and then routes traffic to two separate delivery stations for food pickup. Since the slowest part of the entire drive-thru concept is the customer changing an order once arriving at the drive-thru window and having to pay and receive change, the ordering part of the process usually proceeds relatively quickly. In conjunction with the relocated order board, an employee referred to as the "controller," who wears a conventional wireless communication headset, takes the order from the customer. In addition to the headset, the controller uses a keypad, connected to the cash register system, to ring up the order as it is articulated by the customer. Simultaneously as the order is rung up, the cash register console flashes the order onto conventional CRT indicator screens that are part of this conventional cash register system, so that the employees who are working in the kitchen area of the restaurant know the items ordered and can begin working on that particular order as it is being given. Such indicators are also positioned at each delivery station.

The present invention places a satellite drive-thru building preferably behind and to the side of the primary building in which the kitchen area is located. This satellite or out building is equipped preferably with an ice machine, drink tower and carbonation mechanism, french fry station, exhaust hood ansul system, counter freezer, double compartment sink, hot water heater, HVAC system, power panel, CRT from the cash register system connected with the controller's cash register console, cash register, and drive-thru window built in a bay window fashion. In the preferred embodiment, the satellite building is approximately ten feet by twelve feet and is totally self-contained.

The present invention moves certain food items to the out building from the kitchen area in a new way, by using a pneumatic dispatch system. The dispatch system connects the back line or kitchen area of the primary restaurant building to the satellite out building via (preferably) a six-inch (interior diameter) extruded PVC tube which passes overhead inside the primary restaurant building to the back wall where it then descends into a reinforced concrete box trench under the parking lot to ascend through the floor of the satellite building. The pneumatic dispatch system requires power at only one end, which is called the "power pedestal" and is located adjacent to the kitchen area of the restaurant. The send/receive station or dispatch station at the nonpowered end is located in the satellite out building at a receiving counter and makes no noise whatsoever. Being extremely small, this nonpowered end of the system takes up little space and easily fits in the confined area of the satellite building.

The pneumatic dispatch system is a pressure/vacuum configuration which moves a fast food carrier under pressure in one direction and under negative pressure, or vacuum, on the return in a "push-pull" procedure. A six-inch carrier has been designed for this system which can carry loads up to 5 pounds and distances to 1000 feet. The carrier opens preferably laterally, being hinged on one end with a locking mechanism on the opposite end, which allows for easy loading of wrapped sandwiches. A filler of styrofoam in various lengths allows the carrier to be sent to the satellite with no damage to the food products even when not completely filled with food product. Health department regulations may be met using this carrier if only wrapped food products are sent through the system.

The present invention also preferably requires restriping of the fast food site. With the order board relocated to the right (ingress) side of the building, the controller employee who takes the order in fact controls the flow of traffic through the site. The conventional drive-thru window is referred to as window one or first delivery station, and the traffic lane from the order board location that goes around the primary building to window one is labeled as the first lane or lane one with arrows directing traffic flow around the building. The satellite drive-thru window is referred to as window two or second delivery station, and a new traffic lane labeled as the second lane or lane two is painted from the order board with arrows directing traffic to proceed from the order board straight ahead to the satellite building and window two. After receiving the ordered items from window two, customers may have the option of going straight and exiting the site through a rear exit or turning left and following lane two back into the site where it merges with lane one and exits the site on the left (egress) side of the site.

It is accordingly an object of the present invention to provide a restaurant with one order station and two food delivery stations, one being located remotely from the building containing the order station, so that food may be delivered to customers at two locations and thus increase the speed and efficiency of the restaurant.

It is an additional object of the present invention to provide a restaurant which contains a second food delivery station located remotely of the main restaurant building, and in which food products may be delivered to the second delivery station via pneumatic carriers.

It is an additional object of the present invention to provide automatic and coordinated control of fast food restaurant delivery systems using an individual at the point of order to control flow of vehicles through at least two lanes to respective delivery stations.

Other objects, features, and advantages of the present invention will become apparent with respect to the remainder of this document.

DETAILED DESCRIPTION OF THE DRAWINGS

Figure 1:
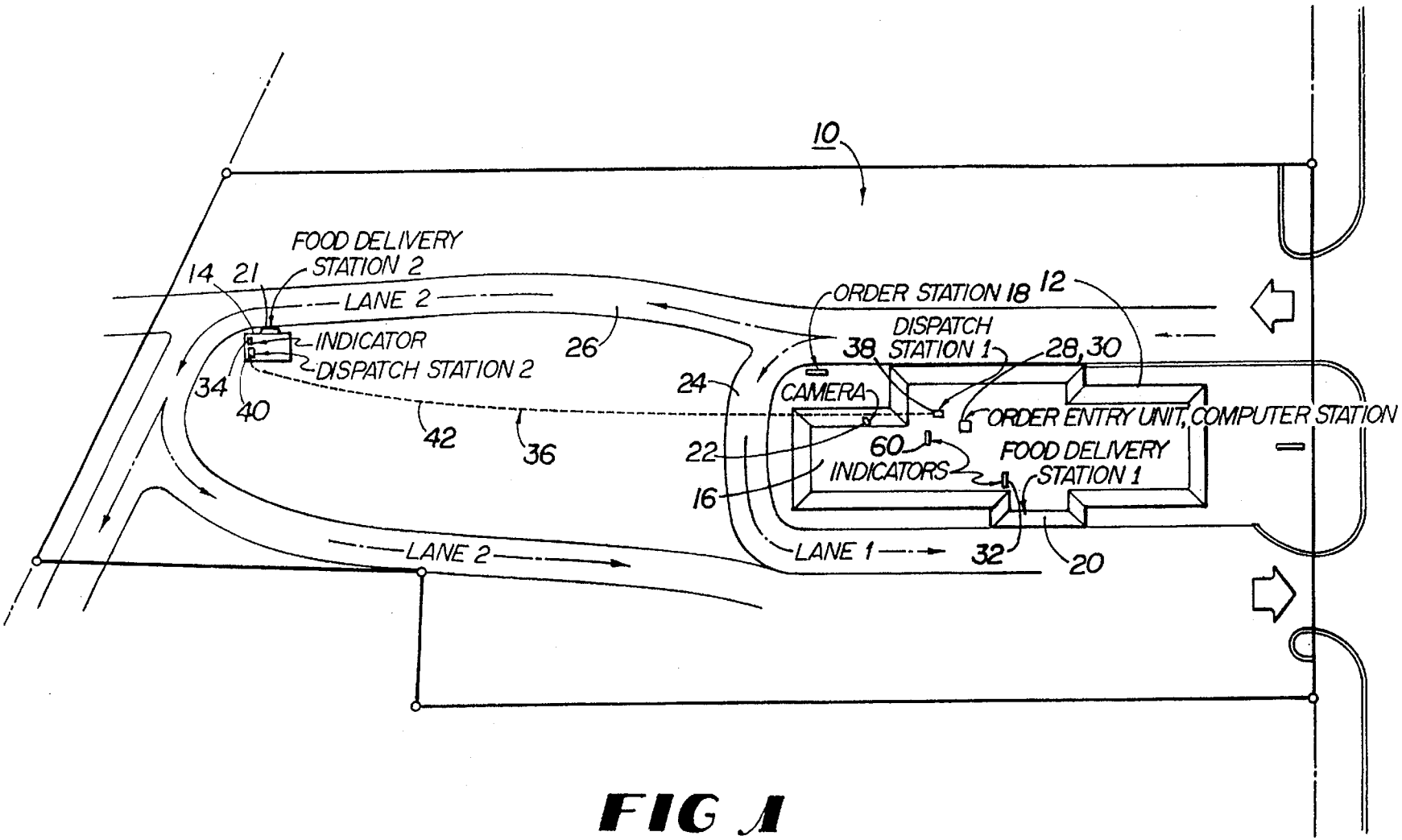
FIG. 1 is a schematic representation of a preferred embodiment of a restaurant according to the present invention.

FIG. 1 is a representation of a preferred embodiment of a restaurant 10 according to the present invention. In the preferred embodiment, restaurant 10 includes a main building 12 and a satellite or out building 14. Main building 12 generally includes a kitchen area 16, preferably located toward the back of main building 12, an order board or station 18 of conventional type, but which has been unconventionally located on the ingress side of the restaurant, and the food delivery window or station 20 through which payment may be made and food delivered to customers.

Main building 12 also includes a television camera or system 22 of conventional nature as used in fast food restaurants, which may be used to monitor the order board 18 and the lanes of traffic leading to and away from the order board 18. A first lane 24 leads from the order board 18 around main building 12 to first food delivery station 20. A second lane 26 leads customers to out building 14 from order board 18 so that payment and food delivery may occur there, thus increasing payment and delivery capacity, and thus speed and efficiency, by 100 percent. A control station 28 which includes an order entry unit 30 is located within main building 12 and is manned by a controller who takes orders as recited by customers into the order board 18, in conventional fashion. The controller enters the order information into a conventional order entry unit 30, which may be portable. Information entered into the order entry unit 30 as to food products ordered appears on indicators 32, such as CRTs used in existing fast food restaurant operations, and a similar or same indicator 34 in out building 14. In the main building 12, the indicators 32 are preferably located at least adjacent to first delivery station 20 and kitchen area 16. The controller confirms the order information to the customer and controls the entire operation by instructing customers to proceed via either lane 1 or lane 2, depending upon the traffic flow and backup existing in both lanes. Floor plans for the kitchen area 16 and the out building 14 are shown in greater detail in FIGS. 2 and 3.

Food products may be transported from kitchen area 16 of main building 12 to out building 14 via pneumatic system 36. Pneumatic system 36 generally comprises a first food dispatch station 38 located adjacent to kitchen area 16, a second dispatch station 40 located in out building 14, and a pneumatic tube 42 running between first dispatch station 38 and second dispatch station 40. The first dispatch station 38, second dispatch station 40, and the tube 42 are shown in greater detail in FIGS. 4 and 5.

Figure 4:
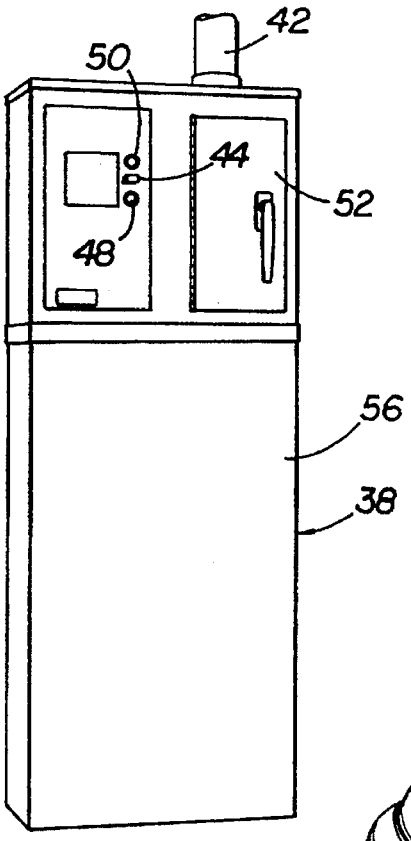
FIG. 4 is a perspective view of a first dispatch station according to the present invention.
Figure 5:
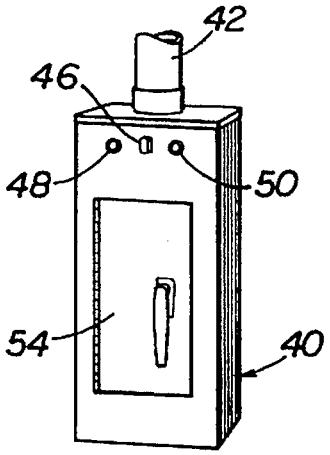
FIG. 5 is a perspective view of a second dispatch station according to the present invention.

The dispatch stations 38, 40 and the pneumatic tube 42, together with the controls, may be a conventional pneumatic system such as those used in banks and department stores. As shown in FIGS. 4 and 5, each dispatch station 38 and 40 contains a control (44, 46 respectively) for actuating delivery of a carrier contained in the pneumatic tube from one dispatch station to the other. A white light indicator 48 on each dispatch station 38, 40, indicates when the user may insert and send a carrier. A red light indicator 50 indicates when transportation is in progress, and loading of carriers is therefore not appropriate. Each dispatch station 38, 40, includes a port (52, 54, respectively) of conventional structure in such pneumatic systems for loading of food carriers. In the preferred embodiment, first dispatch station 38, located in main building 12, contains pump, valve and, if desired, reservoir apparatus (not shown) of conventional nature and structure to apply positive pressure to tube 42 when a carrier is desired to be sent from dispatch station 38 to dispatch station 40 (to the out building), and negative pressure (vacuum) when the fast food carrier must travel from the out building back to the main building (second station 40 to first station 38). This control may be accomplished in conventional fashion, by applying the intake and exhaust ports of a pump, respectively, and directly or indirectly, to the tube via a valve or other appropriate mechanism.

Figure 2:
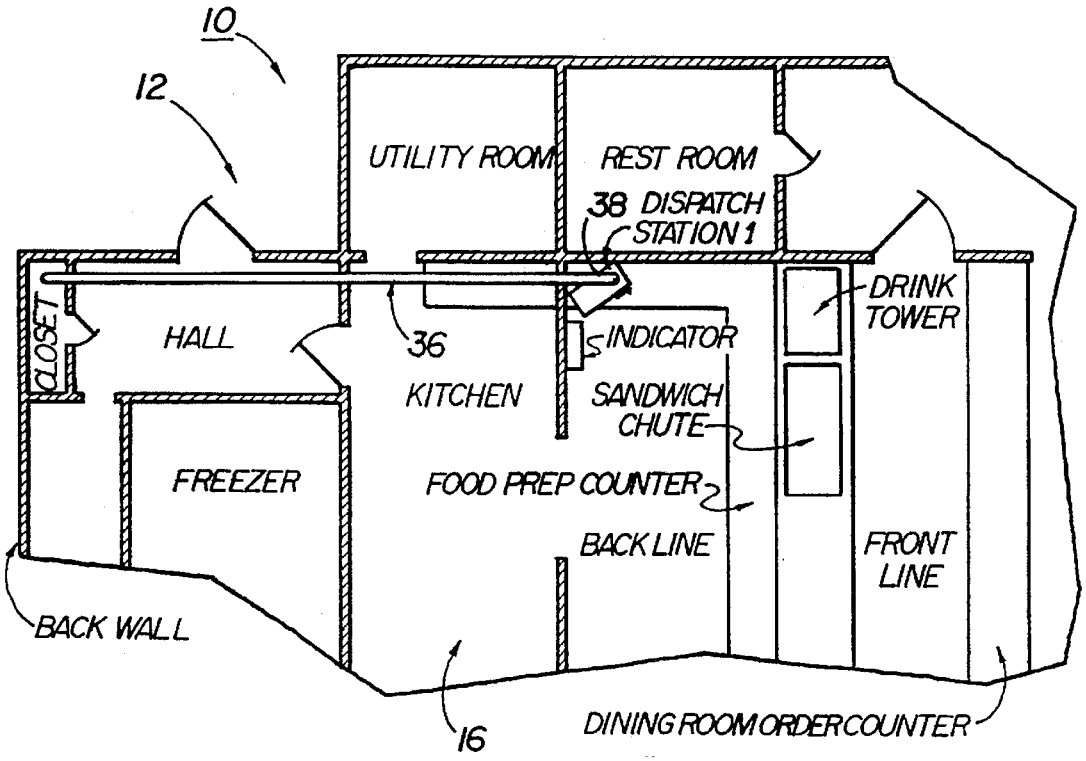
FIG. 2 is a schematic representation of a portion of the main building of the restaurant of FIG. 1.
Figure 3:
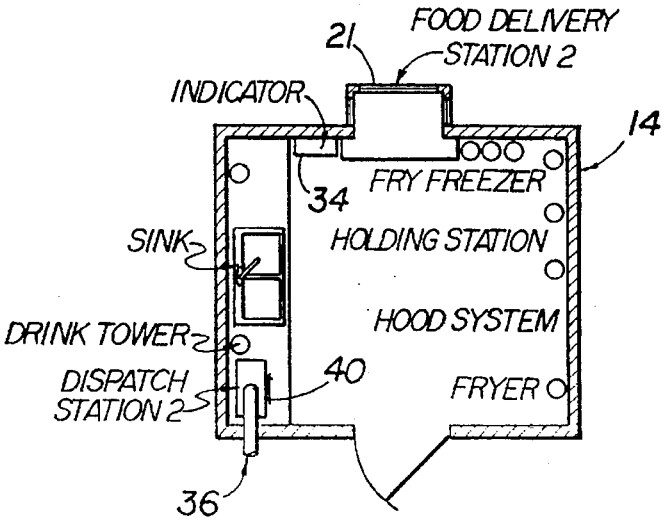
FIG. 3 is a schematic representation of the out building of the restaurant of FIG. 1.
Figure 6:
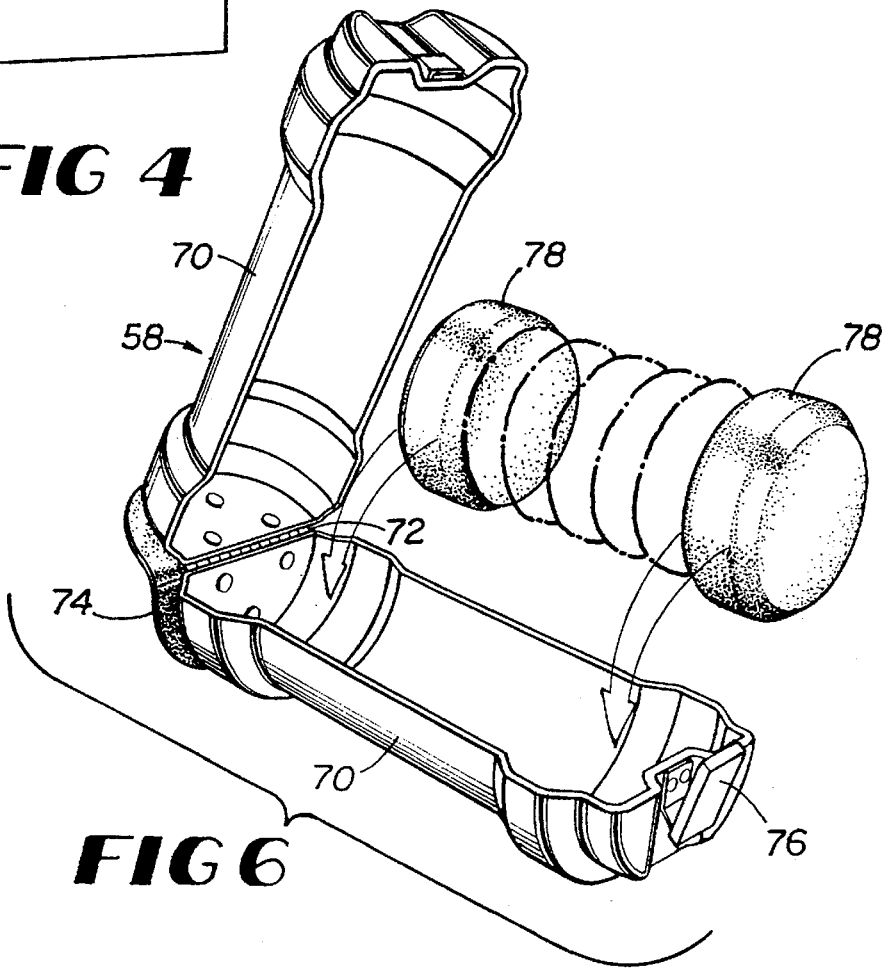
FIG. 6 is a perspective view of a preferred embodiment of a food carrier according to the present invention.

FIGS. 2 and 3 show more closely the arrangement of portions of main building 12 and out building 14. FIGS. 4 and 5 are more detailed views of first dispatch station 38 and second dispatch station 40, respectively. FIG. 6 shows a carrier 58 of a preferred embodiment of the present invention employed to transport food between first dispatch station 38 and a second dispatch station 40.

FIGS. 1 and 2 shows how a conventional kitchen area 16 is arranged, and how it cooperates with components of the present invention. The first dispatch station 38 is located in kitchen area 16 and is preferably a conventional "Power Pedestal" which contains pump apparatus (not shown) and control mechanisms to cause the tube 42 to be pressurized in conventional fashion for deployment of carrier 58. First dispatch station 38 is preferably installed in the "back line" portion of the kitchen area 16, where food is prepared and wrapped. The pneumatic tube 42 leaves the first dispatch station 38 and travels vertically up and into the suspended ceiling, where it bends and runs just above the ceiling toward the back wall of the main building 12. When the pneumatic tube 42 reaches the closet at the end of the hall, it turns and descends into the floor where it again turns and proceeds out from under the foundation of main building 12. The pneumatic tube 42 runs under the parking lot, including under first lane 24, in a reinforced concrete trench that proceeds to out building 14.

FIG. 3 is a schematic view of the floor plan for out building 14. Pneumatic tube 42 ascends from the concrete trench through the floor of out building 14 into second dispatch station 40. The out building 14 is preferably equipped with its own drink tower, sink, water heater, power panel, freezer, french fry station, holding station, exhaust ansul hood system, HVAC system, and a bay-styled drive-thru window (second food delivery station 21). The out building 14 is preferably built in conformance with the architecture, color scheme and building materials used in the main building 12 in order that out building 14 will engender the same consumer recognition and good will for the fast food products being sold, as does the main building 12.

Returning to FIG. 1, the main building can constitute a conventional fast food restaurant building already equipped with a drive-thru window style food delivery station 20. For the present invention, the out building 14 is constructed toward the rear of the fast food restaurant site, and new lanes 24 and 26 are striped off on the site. The out building 14 is outfitted with the required restaurant equipment so that drinks and french fries are prepared preferably in the out building 14. Sandwiches prepared in the primary restaurant building 12 are transported to out building 14 in the (preferably six-inch diameter) carrier 58 using pneumatic system 36.

The sandwiches that are required in out building 14 may thus be prepared in kitchen area 16 of main building 12, wrapped into their respective foil, and loaded into carrier 58 which is then placed in port 52 of first dispatch station 38. At the touch of control 44, the carrier 58 is dispatched through pneumatic tube 42 to the second dispatch station 40 located in out building 14, a distance of approximately 140 feet in the preferred embodiment. The carrier 58 in the preferred embodiment proceeds through pneumatic tube 42 at the rate of approximately 25 feet per second, thus making the trip from first dispatch station 38 to second dispatch station 40 in just over five seconds.

FIG. 6 shows a preferred embodiment of a carrier 58 according to the present invention. Carrier 58 comprises two halves 70 which are attached to one another by a hinge 72. A flexible flange 74, for cooperating with tube 42 in a sliding, substantially airtight relationship, is held in place by hinge 72 with respect to the two halves 70. The end of the carrier 58 opposite the hinge 72 features a latch 76 which is adapted to close the halves 70 together in quick-release fashion. The user simply inserts sandwiches or other desired food products, styrofoam inserts 78 as necessary to protect the food products from sudden stops and starts encountered in system 36, closes the halves 70 together, and latches them in place. Upon arrival at the out building dispatch station 40, the user removes the food products in order reverse to that recited above and returns the carrier 58 to the first dispatch station 38. Any desired carrier structure may be employed.

A typical scenario for the functioning of restaurants according to the present invention is as follows:

The controller is situated at control station 28 which may be a stationary position or constitute a portable order entry unit 30 with conventional headset to allow the controller to communicate. The controller is in charge of controlling the flow of traffic through both food delivery stations 20 and 21 via lanes 24 and 26. She or he is stationed inside main building 12 preferably in the kitchen area 16 so that the flow of the crew preparing the sandwiches may also be observed. The controller wears a conventional radio headset as used in fast food operations tuned to the frequency of order board 18 for communications to customers regarding their orders. The controller employs order entry unit 30 in conjunction with conventional computerized cash registers so that he or she may see the total price of the order, and communicate that information to the customer. After the price is communicated, the customer is directed by the controller to proceed either to first (conventional) drive-thru window delivery station 20, or the new out building 14 drive-thru window food delivery station 21.

The controller makes the decision as to which drive-thru window the customer should be directed to, based on the items ordered and the number of cars already in queue for each of the delivery stations 20 and 21. In the preferred embodiment, all menu items are available at conventional first food delivery station 20, but milk shakes and baked potatoes are not available at out building drive-thru window food delivery station 21. The out building 14 has its own drink tower, ice machine, and french fry station, and it receives sandwiches through pneumatic system 36.

A closed circuit television system 22 of conventional nature is positioned in the vicinity of order board 18 with the monitor positioned inside main building 12 in kitchen area 16 so that the controller is aware of cars approaching order board 18. Additionally, there may be a pressure-sensitive strip buried in the pavement at order board 18 which sounds an audible tone when a car approaches order board 18. When the controller takes an order, if part of that order includes baked potatoes or milk shakes, the customer is directed to proceed to first food delivery station 20 using first lane 24 as marked on the asphalt with arrows leading around the main building 12. When a customer order does not include baked potatoes or milk shake, or for any other reasons, the controller can direct the customer to either first food delivery station 20 located in main building 12 or the out building 14 second food delivery station 21. If first food delivery station 20 is backed up because of an unusually large order or a change of order when the customer reaches the window, for instance, then the next several cars can be directed to second delivery station 21. If a customer has a large order or multiple orders (such as when one car is picking up separately bagged orders for several different customers), then the controller can send the next several cars to the opposite delivery station and keep traffic flowing.

When the controller has made a decision as to which drive-thru delivery station 20 or 21 the current customer will be directed, and the order has been entered into the cash register system, the items ordered are flashed onto the indicators 32 and 34, as well as in the kitchen area (60) along with an indication on the indicators as to which delivery station should receive that particular order. If the order is being prepared for the conventional, first delivery station 20, the people working drive-thru there will begin to get the order ready. Drinks will be drawn, french fries gathered, baked potatoes packaged, milk shakes made, and sandwiches collected when they come down the sandwich chute from the back line. The payment required for that order is also relayed to the cash register at delivery station 20, where the money is collected, change given if required, and the ordered items delivered. The customer leaving first delivery station 20 will proceed to merge with traffic from second lane 26, as well as with cars leaving parking places along the edge of the parking lot, in order to exit the site.

If the controller has determined that a customer can or should be served at out building 14 delivery station 21, then, when the order is flashed on the indicator, it will indicate that such order is being directed to second delivery station 21. The workers in the out building 14 will see that the next customer is being sent to them, and they will begin the preparation of items in a similar fashion to the workers in the main building 12. Drinks are drawn, fries are packaged, and bags are readied for the items ordered. In the primary building 12, the workers on the back line have seen the order, and know that it is being sent to the out building 14. Sandwiches are prepared exactly like they are when being served in the main building 12. However, instead of putting the prepared sandwiches in the sandwich chute, the worker takes the sandwiches and loads them into carrier 58. Depending on the number of sandwiches ordered, they are placed in carrier 58 and a styrofoam filler is inserted to occupy any unused space in carrier 58. (Obviously, sandwiches may be sent to the outbuilding 14 for storage there until time for delivery to a customer, in order to anticipate future orders and traffic.) The worker then places carrier 58 into port 52 of power pedestal or first dispatch station 38, and closes the door. The worker uses the red and white light indicators, 48 and 50 respectively. When the carrier 58 is outside of dispatch station 38, the lights are off. When the carrier 58 is placed into dispatch station 38, the white light illuminates at both dispatch stations 38 and 40, notifying the workers at both dispatch stations that system 36 is being loaded with a carrier 58. When the worker in the main building 12 pushes the send control 44, the red lights 50 at both dispatch stations illuminate to warn that system 36 is activated and that a transfer is in progress. Simultaneously with lights illuminating, the ports 52 and 54 of both dispatch stations are automatically locked. When the transfer is completed, and the carrier 58 is at the second dispatch station 40 in out building 14, the red light 50 at the second dispatch station 40 is extinguished (as well as at first dispatch station 38) and the port 54 is automatically unlocked. After the carrier 58 is extracted, the white light 48 on both stations is extinguished. Sandwiches are removed from carrier 58 and placed with other food products so that the sacked order is ready to be delivered to the customer at drive-thru window second delivery station 21. The time required to send the sandwiches to the out building 14 is no greater than the time required to drop the sandwiches in the sandwich chute on the front line in main building 12. When the worker at the out building window 21 is collecting money, making change, and delivering the sacked order to the customer, the other worker in the out building can close and reload the carrier 58 and send it back to first dispatch station 38 in main building 12.

By utilizing a single person who is responsible for taking orders and routing cars to the most advantageous drive-thru window, based on items ordered and backup at two windows, the time to which a customer is subjected waiting in line between placing the order and picking up the order can be cut drastically. Additionally, because of the speed with which the pneumatic dispatch system 36 can deliver items between dispatch stations 38 and 40, the employees in the back line area making the sandwiches can be better utilized. Without adding employees, but by better use of existing employees, service at both drive-thru window delivery stations can be greatly improved, making for happier customers and a better bottom line for the restaurant owner.

The foregoing disclosure has been made for purposes of explanation and illustration of a preferred embodiment of the present invention. Modifications, changes, additions and deletions may be made without departing from the scope or spirit of the invention.

What is claimed is:

1. A restaurant which permits delivery of fast food products from a kitchen area to a food delivery station, comprising:

a. a first dispatch station located adjacent to the kitchen area, comprising a first port for loading a fast food carrier;

b. a fast food order indicator located adjacent to the kitchen area for indicating customer orders of fast food products;

c. a second dispatch station located adjacent to the food delivery station, comprising a second port for loading the fast food carrier;

d. a pneumatic tube connecting the first and second ports of the dispatch stations;

e. an air supply for applying pressure to the pneumatic tube in order to cause the fast food carrier to be dispatched from the first dispatch station to the second dispatch station, and from the second dispatch station to the first dispatch station;

f. a control on each dispatch station for actuating the air supply;

g. an order entry unit at an order entry station, into which unit, customer orders for the fast food products may be entered and transmitted to the order indicator located adjacent to the kitchen area; and h. a fast food carrier adapted to contain a fast food product and transport it through the pneumatic tube from the first dispatch station to the second dispatch station.

2. A restaurant according to claim 1 in which the air supply is adapted selectively to provide positive and negative air pressure to the pneumatic tube, and is located at the first dispatch station.

3. A restaurant according to claim 1 in which the food delivery station is located in an outbuilding that is separate from a building in which the kitchen area is located.

4. A restaurant according to claim 3 further comprising an additional food delivery station located in the building in which the kitchen area is located, and two traffic lanes, one leading from the order entry station to said food delivery station, and the second leading from the order entry station to the other food delivery station.

5. A restaurant according to claim 4 in which the outbuilding also comprises an order indicator coupled to the order entry unit.

6. A restaurant, comprising:

a. a kitchen area adapted for preparation of food products and a first dispatch station located adjacent to the kitchen area, which dispatch station contains a port in which a fast food carrier may be placed;

b. a food delivery area adapted for delivery of food to customers, which food delivery area contains at least a soft drink service apparatus, and a second dispatch station located adjacent to the food delivery area, which dispatch station contains a port in which a fast food carrier may be placed;

c. a pneumatic tube connecting the ports of the first and second dispatch stations;

d. a fast food carrier adapted to be placed in the ports of the dispatch stations and to contain fast food products, comprising a hatch for loading the fast food products into the carrier, at least one seal corresponding in size to an inner diameter of the pneumatic tube so as to permit the carrier to move in substantially sealed and sliding relationship with respect to the tube, and dampening structure adapted to be interposed between the carrier and the fast food product in order to absorb shock imposed on the fast food products upon arrival of the carrier at a dispatch station;

e. a pressurizing apparatus for applying a positive and a negative pressure to the pneumatic tube; and f. a control located at each dispatch station for actuating the pressurizing apparatus in order to cause the fast food carrier to be dispatched between the first and second dispatch stations.

7. A restaurant according to claim 6 in which the food delivery area is located in an outbuilding separate from the kitchen area, and the pneumatic tube runs under driveway areas navigated by customers who are purchasing fast food items from the restaurant.

8. A restaurant according to claim 6 in which the food delivery area further comprises a french fry preparation station.

9. A restaurant according to claim 6 further comprising an order entry unit into which customer orders of fast food products may be entered, and an order indicator located adjacent to the kitchen area which is adapted to display the customer orders entered into the order entry unit.

10. A restaurant according to claim 9 in which the food delivery area is located in an outbuilding, and the order entry unit is located on a side of the restaurant that is the same as the side on which the outbuilding is located.

11. A restaurant according to claim 6 in which the dampening structure comprises at least one styrofoam insert dimensioned generally to correspond to the dimensions of the interior of the fast food carrier.

12. A restaurant according to claim 11 in which the plastic insert is placed in the interior of the fast food carrier.

13. A restaurant according to claim 6 in which the pressurizing apparatus is located adjacent to the first dispatch station, and is adapted to apply positive pressure to the pneumatic tube when the fast food carrier is being dispatched to the second dispatch station, and negative pressure when to the pneumatic tube when the fast food carrier is being dispatched to the first dispatch station.

14. A restaurant according to claim 13 in which the pressurizing apparatus includes a pump and a valve interposed between the pump and the pneumatic tube in order to cause positive and negative pressure to be applied selectively from the pump to the tube.

15. A restaurant, comprising:

a. a kitchen area adapted for preparation of food products and a first dispatch station located adjacent to the kitchen area, which dispatch station contains a port in which a fast food carrier may be placed;

b. a food delivery area located in an outbuilding that is separate from the kitchen area, which food delivery area is adapted for delivery of food to customers, which food delivery area contains at least a soft drink service apparatus, and a second dispatch station located adjacent to the food delivery area, which dispatch station contains a port in which a fast food carrier may be placed;

c. a pneumatic tube connecting the ports of the first and second dispatch stations for conveying the food carrier between the first and second dispatch stations;

d. an order entry unit located at an order entry station, into which unit customer orders of fast food items may be entered, which order entry station is located on a side of the restaurant that is the same as the side on which the outbuilding is located;

e. a customer order indicator located adjacent to the kitchen area for indicating customer orders of fast food products entered into the order entry unit;

f. a fast food carrier adapted to be placed in the ports of the dispatch stations and to contain fast food products, comprising a hatch for loading the fast food products into the carrier, at least one seal corresponding in size to an inner diameter of the pneumatic tube so as to permit the carrier to move in substantially sealed and sliding relationship with respect to the tube, and dampening structure adapted to be interposed between the carrier and the fast food product in order to absorb shock imposed on the fast food products upon arrival of the carrier at a dispatch station;

g. a pressurizing apparatus for applying a positive and a negative pressure to the pneumatic tube; and h. a control located at each dispatch station for actuating the pressurizing apparatus in order to cause the fast food carrier to be dispatched between the first and second dispatch stations.

16. A restaurant according to claim 15 in which the outbuilding and the kitchen area are separated by a driveway which is navigated by vehicles operated by customers whose orders have been entered into the order entry unit, and in which the pneumatic tube runs beneath the driveway between the first and second dispatch stations.

17. A restaurant according to claim 15 further comprising a second food delivery station located in the same building as the kitchen area, and two traffic lanes, one leading from the order entry station to the outbuilding food delivery station, and the second leading from the order entry station to the second food delivery station.

18. A restaurant according to claim 15 in which the dampener comprises at least one styrofoam insert dimensioned generally to be interposed between the carrier and the food product.

19. A restaurant according to claim 15 in which the carrier hatch is located on one end of the carrier.

20. A restaurant according to claim 15 in which the food delivery area further comprises a french fry preparation station.

* * * * *